US007459179B2

(12) United States Patent
Prodoehl et al.

(10) Patent No.: US 7,459,179 B2
(45) Date of Patent: Dec. 2, 2008

(54) PROCESS FOR MAKING A FIBROUS STRUCTURE COMPRISING AN ADDITIVE

(75) Inventors: Michael Scott Prodoehl, West Chester, OH (US); Kenneth Douglas Vinson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 522 days.

(21) Appl. No.: 11/002,166

(22) Filed: Dec. 2, 2004

(65) Prior Publication Data

US 2006/0121207 A1 Jun. 8, 2006

(51) Int. Cl.
*B05D 1/12* (2006.01)

(52) U.S. Cl. ..... 427/185; 427/482; 427/195

(58) Field of Classification Search ..... 427/459, 427/477, 482, 485, 185, 195, 296
See application file for complete search history.

(56) References Cited

U.S. PATENT DOCUMENTS

| | | | | |
|---|---|---|---|---|
| 2,030,483 | A | 2/1936 | Uong | |
| 3,210,240 | A | 10/1965 | Read et al. | |
| 3,248,253 | A | 4/1966 | Barford et al. | |
| 3,461,032 | A * | 8/1969 | Brandts et al. | 162/266 |
| 3,484,275 | A | 12/1969 | Lewicki | |
| 3,919,042 | A * | 11/1975 | Spiller | 162/175 |
| 4,175,055 | A * | 11/1979 | Goller et al. | 502/101 |
| 4,556,560 | A | 12/1985 | Buckingham | |
| 5,611,890 | A | 3/1997 | Vinson et al. | |
| 5,622,599 | A | 4/1997 | Sproule et al. | |
| 5,672,249 | A | 9/1997 | Vinson et al. | |
| 5,700,352 | A | 12/1997 | Vinson et al. | |
| 5,759,346 | A | 6/1998 | Vinson | |
| 5,766,366 | A | 6/1998 | Ferguson et al. | |
| 5,830,317 | A | 11/1998 | Vinson et al. | |
| 5,866,286 | A | 2/1999 | Christy et al. | |
| 5,942,087 | A | 8/1999 | Pruszynski | |
| 5,958,185 | A | 9/1999 | Vinson et al. | |
| 5,985,030 | A | 11/1999 | Taylor et al. | |
| 5,988,001 | A | 11/1999 | Vucinovich | |
| 6,238,520 | B1 | 5/2001 | Greenwood | |
| 6,355,330 | B1 | 3/2002 | Koslow et al. | |
| 6,417,425 | B1 | 7/2002 | Whitmore et al. | |
| 6,458,299 | B1 | 10/2002 | Wierer et al. | |
| 6,494,988 | B1 | 12/2002 | Cedra et al. | |

(Continued)

FOREIGN PATENT DOCUMENTS

| | | |
|---|---|---|
| WO | WO 89/08741 A1 | 9/1989 |

(Continued)

OTHER PUBLICATIONS

McGraw Hill Encyclopedia of Science and Technology vol. 13, pp. 89-90, 1997.*

(Continued)

*Primary Examiner*—Frederick J Parker
(74) *Attorney, Agent, or Firm*—C. Brant Cook

(57) ABSTRACT

Processes for making fibrous structures wherein the process includes the step of contacting a fibrous structure with a solid additive such that the solid additive is present on a surface of the fibrous structure at a greater level than within the fibrous structure a solid additive are provided.

17 Claims, 5 Drawing Sheets

U.S. PATENT DOCUMENTS

| | | | |
|---|---|---|---|
| 6,521,088 | B1 | 2/2003 | Richardson et al. |
| 6,720,024 | B2 | 4/2004 | Poliniak et al. |
| 2003/0045847 | A1 | 3/2003 | Whitmore et al. |
| 2004/0071758 | A1 | 4/2004 | Von Heimburg et al. |

FOREIGN PATENT DOCUMENTS

| | | | |
|---|---|---|---|
| WO | WO 01/04417 | | 1/2001 |
| WO | WO 03/076715 | A2 | 9/2003 |
| WO | WO 03/076716 | A3 | 9/2003 |
| WO | WO 03/076717 | A1 | 9/2003 |
| WO | WO 03/076718 | A2 | 9/2003 |
| WO | WO 03/076719 | A2 | 9/2003 |
| WO | WO 2004/044323 | A1 | 5/2004 |

OTHER PUBLICATIONS

Research Disclosure "Powder impregnated tissue" Research Disclosure Database No. 363041; Research Disclosure Journal No. 36341; Published in Jul. 1994.

U.S. Appl. No. 11/002,855, filed Dec. 2, 2004, Vinson et al.

U.S. Appl. No. 11/001,891, filed Dec. 2, 2004, Vinson et al.

U.S. Appl. No. 11/002,854, filed Dec. 2, 2004, Vinson et al.

* cited by examiner

PROCESS FOR MAKING A FIBROUS STRUCTURE COMPRISING AN ADDITIVE

FIELD OF THE INVENTION

The present invention relates to processes for making fibrous structures. More particularly, the present invention relates to processes for making fibrous structures comprising an additive, especially a solid additive, and to fluidizable mixtures comprising a solid additive that are useful in such processes.

BACKGROUND OF THE INVENTION

Processes for making fibrous structures that comprise an additive, especially a solid additive, are known in the art.

It is known in the art that additives can be added to fibrous slurries prior to forming a fibrous structure. Also, it is known that additives can be liquefied and/or added to a liquid, especially aqueous, vehicle and then applied to fibrous structures by spraying such liquid vehicle onto a fibrous structure. Further, it is known that additives can be brushed onto fibrous structures.

In the fine paper/newsprint art where the fine paper/newsprint inherently exhibits an average lint value of well under 1, it is known to electrostatically charge powder particles and deliver the powder particles to the fibrous structure.

There exists problems with each of the prior art processes described above. In particular, the brushing process loosely associates its additive with the fibrous structure such that the average lint value for such fibrous structure is extremely high and not readily acceptable by consumers.

Accordingly, there is a need for a process for making a fibrous structure that comprises an additive and that avoids the problems associated with the prior art processes.

SUMMARY OF THE INVENTION

The present invention fulfills the needs described above by providing a process for making a fibrous structure comprising a solid additive and fluidizable mixtures comprising a solid additive useful in such processes.

In one example of the present invention, a process for making a fibrous structure comprising a solid additive wherein the solid additive is present on a surface of the fibrous structure at a greater level by weight than within the fibrous structure, is provided.

In another example of the present invention, a process for making a fibrous structure comprising the step of contacting a fibrous structure with a solid additive via a non-contacting solid additive applicator, is provided.

In yet another example of the present invention, a process for making a fibrous structure comprising the step of combining a plurality of fibers and a solid additive such that a fibrous structure having a surface upon which the solid additive is concentrated is formed, is provided.

In still another example of the present invention, a fluidizable mixture comprising a solid additive and a fluidizing agent, is provided.

In even still yet another example of the present invention, a fluidizable mixture consisting of a solid component wherein the solid component comprises a carbohydrate polymer solid additive and a fluidizing agent, is provided.

In even yet another example of the present invention, a process for treating a through-air-dried fibrous structure wherein the process comprises the step of applying a solid additive to a through-air-dried fibrous structure such that the solid additive is retained at a higher concentration in areas of the through-air-dried fibrous structure that contain more moisture than areas that contain less moisture, is provided.

Accordingly, the present invention provides processes for making fibrous structures comprising a solid additive and fluidizable mixtures comprising a solid additive useful in such processes.

DETAILED DESCRIPTION OF THE INVENTION

Definitions

Figure 1:
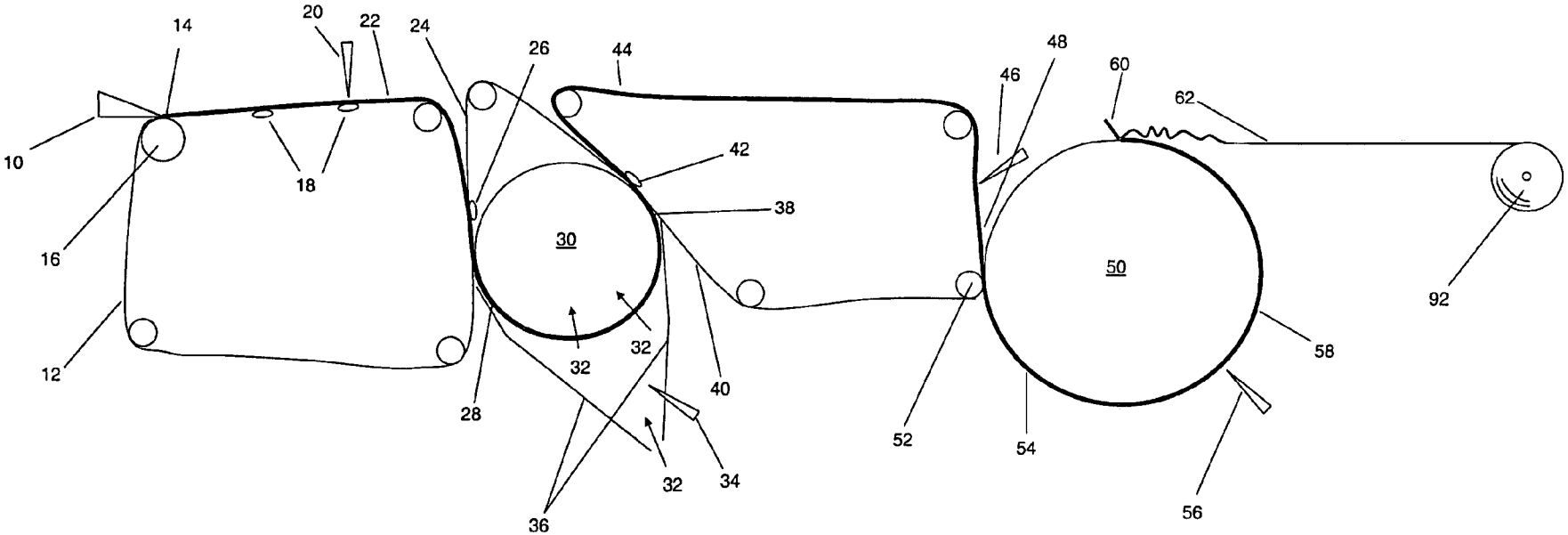
FIG. 1 schematically illustrates a fibrous structure manufacturing device that incorporates an example of a process according to the present invention.

"Additive" as used herein means a material that is present in and/or on a fibrous structure at low levels. For example, an additive is a material that is present in and/or on a fibrous structure at levels less than 50% and/or less than 45% and/or less than 40% and/or less than 30% and/or less than 20% and/or less than 10% and/or less than 5% and/or less than 3% and/or less than 1% and/or less than 0.5% to about 0% by weight of the fibrous structure.

"Solid additive" as used herein means an additive that is capable of being applied to a surface of a fibrous structure in a solid form. In other words, the solid additive of the present invention can be delivered directly to a surface of a fibrous structure without a liquid phase being present, i.e. without melting the solid additive and without suspending the solid additive in a liquid vehicle or carrier. As such, the solid additive of the present invention does not require a liquid state or a liquid vehicle or carrier in order to be delivered to a surface of a fibrous structure. The solid additive or the present invention may be delivered via a gas or combinations of gases. For purposes of the present invention, delivery of an additive, liquid and/or solid, into a slurry of fibers used to produce a fibrous structure is not encompassed by this phrase. However, such an additive may be present in a fibrous structure so long as the fibrous structure also comprises a solid additive as defined herein. Further, an additive, liquid and/or solid, delivered to a fibrous structure via a liquid vehicle, such as a latex emulsion, may be present in a fibrous structure so long as the fibrous structure also comprises a solid additive as defined herein. Further, an additive, liquid and/or solid, delivered to a fibrous structure via melting, such as a hot melt adhesive, may be present in a fibrous structure so long as the fibrous structure also comprises a solid additive as defined herein. In simplistic terms, a solid additive is an additive that when placed within a container, does not take the shape of the container.

The solid additive may comprise a fiber (for example less than about 50% and/or less than about 40% and/or less than about 30% and/or less than about 20% and/or less than about 10% and/or less than about 5%) provided the solid additive exhibits an aspect ratio index less than about 100 and/or less than about 60 and/or less than about 30 and/or less than about 15. "Aspect ratio index" as used herein is the aspect ratio of the fiber portion of the solid additive multiplied by the weight percent of the fiber that is present as a solid additive. For example, when a fibrous structure comprises a solid additive comprising 50% by weight of a fiber exhibiting an aspect ratio of 50, the resulting aspect ratio index is 25.

"Density" or "Apparent density" as used herein means the mass per unit volume of a material. For fibrous structures, the density or apparent density can be calculated by dividing the basis weight of a fibrous structure sample by the caliper of the fibrous structure sample with appropriate conversions incorporated therein. Density and/or apparent density used herein has the units $g/cm^3$. The density of a material, such as a solid additive in accordance with the present invention is determined according to the Density Test Method described herein. Again, the units for density of a material as used herein are $g/cm^3$.

"Average particle size" or "Particle Size Mean" as used herein for a material, such as a solid additive in accordance with the present invention, is determined according to the Average Particle Size Test Method described herein. The units for average particle size as used herein are μm.

"Sphericity", symbolized "$\Phi_s$" is a term which used herein relates to the shape of a solid additive. Sphericity is defined as:

$$\Phi_s = \frac{6\upsilon_p}{D_p S_p}$$

wherein: $D_p$ is equivalent spherical diameter of a solid additive, $S_p$ is the surface area of the solid additive, and $\upsilon_p$ is the volume of the solid additive. The equivalent spherical diameter is defined as the diameter of a sphere having the same volume as the solid additive. $D_p$ is closely approximated by the nominal size based on screen analysis or microscopic analysis. Those skilled in the art will recognize that surface area can readily be determined by adsorption measurements or from the pressure drop in a bed of solid additives. Sphericity varies between 0 and 1. A perfectly spherical solid additive exhibits a sphericity of 1; deviations from perfect sphere, for example platy materials such as mica, clay, or talc, possess much lower sphericity.

"Fiber" as used herein means an elongate particulate having an apparent length greatly exceeding its apparent diameter, i.e. a length to diameter ratio of at least about 10. A fiber can be a solid additive. Fibers having a non-circular cross-section are common; the "diameter" in this case may be considered to be the diameter of a circle having cross-sectional area equal to the cross-sectional area of the fiber. More specifically, as used herein, "fiber" refers to papermaking fibers. The present invention contemplates the use of a variety of papermaking fibers, such as, for example, natural fibers or synthetic fibers, or any other suitable fibers, and any combination thereof.

Natural papermaking fibers useful in the present invention include animal fibers, mineral fibers, plant fibers and mixtures thereof. Animal fibers may, for example, be selected from the group consisting of: wool, silk and mixtures thereof. Plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); and mixtures thereof.

"Fiber Length", "Average Fiber Length" and "Weighted Average Fiber Length", are terms used interchangeably herein all intended to represent the "Length Weighted Average Fiber Length" as determined for example by means of a Kajaani FiberLab Fiber Analyzer commercially available from Metso Automation, Kajaani Finland. The instructions supplied with the unit detail the formula used to arrive at this average. The recommended method for measuring fiber length using this instrument is essentially the same as detailed by the manufacturer of the FiberLab in its operation manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, fiber length may be determined by sending the short fibers to a contract lab, such as Integrated Paper Services, Appleton, Wis.

Nonlimiting examples of suitable fibers used in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

"Fibrous structure" as used herein means a structure that comprises one or more fibers. Nonlimiting examples of processes for making fibrous structures include known wet-laid papermaking processes and air-laid papermaking processes. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a fibrous structure is formed. For example, in typical papermaking processes, the fibrous structure is the fibrous structure that is wound on the reel at the end of papermaking, but before converting thereof into a sanitary tissue product. Those of skill in the art will appreciate that fine paper, such as writing paper and/or other paper that is not typically suited for use in sanitary tissue products, may be excluded from the scope of the present invention, especially since the typical lint values for such "fine" paper is less than 1. In one example, the fibrous structure is a wet-laid fibrous structure.

"Sanitary tissue product" comprises one or more fibrous structures, converted or not, that is useful as a wiping implement for post-urinary and post-bowel movement cleaning (toilet tissue), for otorhinolaryngological discharges (facial tissue), and multi-functional absorbent and cleaning uses (absorbent towels).

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or sanitary tissue product comprising the fibrous structure.

"Dry Tensile Strength" (or simply "Tensile Strength" as used herein) of a fibrous structure and/or sanitary tissue product is measured as follows. One (1) inch by five (5) inch (2.5 cm×12.7 cm) strips of fibrous structure and/or sanitary tissue product are provided. The strip is placed on an electronic tensile tester Model 1122 commercially available from Instron Corp., Canton, Mass. in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

"Peak Load Stretch" (or simply "Stretch") as used herein is determined by the following formula:

$$\frac{\text{Length of Fibrous } Structure_{PL} - \text{Length of Fibrous } Structure_I}{\text{Length of Fibrous } Structure_I} \times 100$$

wherein:

Length of Fibrous $Structure_{PL}$ is the length of the fibrous structure at peak load;

Length of Fibrous $Structure_I$ is the initial length of the fibrous structure prior to stretching;

The Length of Fibrous $Structure_{PL}$ and Length of Fibrous $Structure_I$ are observed while conducting a tensile measurement as specified in the above. The tensile tester calculates the stretch at Peak Load. Basically, the tensile tester calculates the stretches via the formula above.

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$ (20.3 $cm^2$). The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Lint" as used herein means any material that originated from a fibrous structure and/or sanitary tissue product comprising such fibrous structure that remains on a surface after which the fibrous structure and/or sanitary tissue product comprising such fibrous structure has come into contact. The lint value of a fibrous structure and/or sanitary tissue product comprising such fibrous structure is determined according to the Lint Test Method described herein.

"Dust" as used herein means any material that originated from a fibrous structure and/or sanitary tissue product comprising such fibrous structure that becomes airborne after the fibrous structure and/or sanitary tissue product comprising such fibrous structure has been subjected to a force.

"Surface of a fibrous structure" as used herein means that portion of the fibrous structure that is exposed to the external environment. In other words, the surface of a fibrous structure is that portion of the fibrous structure that is not completely surrounded by other portions of the fibrous structure.

"Ply" or "Plies" as used herein means an individual fibrous structure optionally to be disposed in a substantially contiguous, face-to-face relationship with other plies, forming a multiple ply fibrous structure product and/or sanitary tissue product. It is also contemplated that a single fibrous structure can effectively form two "plies" or multiple "plies", for example, by being folded on itself.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Applicator

An applicator may be used to contact, deposit and/or associate the solid additive with a surface of the fibrous structure.

In one example, the applicator places an electrostatic charge on the solid additive to be delivered to the surface of the fibrous structure. The charge on the solid additive may be opposite the charge associated directly or indirectly with the part or all of the target fibrous structure.

Alternatively, part or all of the target fibrous structure may represent a grounding surface relative to the charged solid additive. Preferably, an electrostatic attraction between the solid additive and oppositely-charged and/or grounded fibrous structure is created.

In another example, an applicator that places a charge on the solid additive is a spray gun system also referred to as a powder coater. A spray gun system is a non-contacting applicator which delivers a solid additive without the applicator contacting the fibrous structure. Nonlimiting examples of suitable spray gun systems are commercially available from Nordson Corporation under the trademark Sure Coat® Manual Spray Gun System.

In one example, a plurality of applicators may be in operation on a single fibrous structure making machine. The applicators may be positioned such that the width of the fibrous structure to be treated is covered by the solid additive being delivered by the applicators.

In another example, one applicator may comprise numerous outlets, such as nozzles, from which the solid additive is applied to the fibrous structure.

Grounding Material

The fibrous structure of the present invention may be associated directly or indirectly with a grounding material. "Grounding material" as used herein means any material that exhibits an electrostatic attraction for a solid additive.

In one example, a grounding material is a reservoir to accept or provide electrons, including conductive materials and/or materials possessing a net excess or absence of electrons relative to the solid additive as described hereinbefore.

In another example, the fibrous structure comprises a grounding material. Moisture/water present in and/or on the fibrous structure may act as a grounding material. For example, water in the interstices of the fibrous structure may be grounded via the fibrous structure optionally such interstitial water can provide a conductive path to the water system and thereby to the metal frame of the machine and ultimately to the earth. Water is typically present in the fibrous structure during papermaking until the fibrous structure is completely dried.

Alternatively, moisture/water may be added to a previously dried fibrous structure, such as in a converting process such as by dipping and/or spraying water onto the fibrous structure prior to contacting the fibrous structure with the solid additive.

In another example, the belt or fabric on which the fibrous structure is carried may comprise a grounding material. The ground material in the belt or fabric may be positioned within and/or on a side of the belt or fabric.

In yet another example, the grounding material may be separate from, but associated with the belt or fabric upon which the fibrous structure is carried. For example, a grounding material may be positioned on the belt or fabric, between the fibrous structure and the belt or fabric or adjacent to the belt or fabric opposite the fibrous structure such that the belt or fabric is positioned between the grounding material and the fibrous structure.

Ground material whether within or separate from the belt or fabric may be disposed in a pattern to cause the solid additive to deposit in a corresponding pattern.

Process for Making Fibrous Structures

The solid additive(s) of the present invention may be applied to a surface of a fibrous structure at any point during the papermaking and/or converting process so long as a surface of the fibrous structure is present upon which the solid additive(s) may be deposited. Application of a solid additive to a surface of the fibrous structure may take place while the fibrous structure is supported on the embryonic foraminous wire, a drying felt or fabric, while the fibrous structure is in contact with a cylindrical dryer, such as a Yankee dryer, after removal from a Yankee dryer, during a converting process prior to or after slitting and/or sawing, or any other suitable position with the papermaking and/or converting process.

FIGS. 1-4 schematically illustrate a nonlimiting example of a fibrous structure making machine and process of the present invention. Various tensioning and turning roll elements of FIGS. 1-4 are included but left unlabeled for simplicity.

As shown in FIGS. 1-4, a headbox 10 deposits a slurry (aqueous dispersion) of papermaking fibers onto a foraminous wire 12 forming a nascent wet web at 14, as the fibrous slurry drains, with or without the assistance of a vacuum breast roll 16. Dewatering of the wet web 14 can be further assisted by vacuum elements 18. One or more solid additive applicators may be positioned and/or operating at various positions within the fibrous structure making machine and/or converting line. For example, a solid additive applicator 20, deposits a solid additive onto the surface of wet web 14 producing a coated, dewatered, wet web 22. The approximate moisture content at the point of solid additive application by applicator 20 can be in the range of from about 80% to about 90%.

Figure 2:
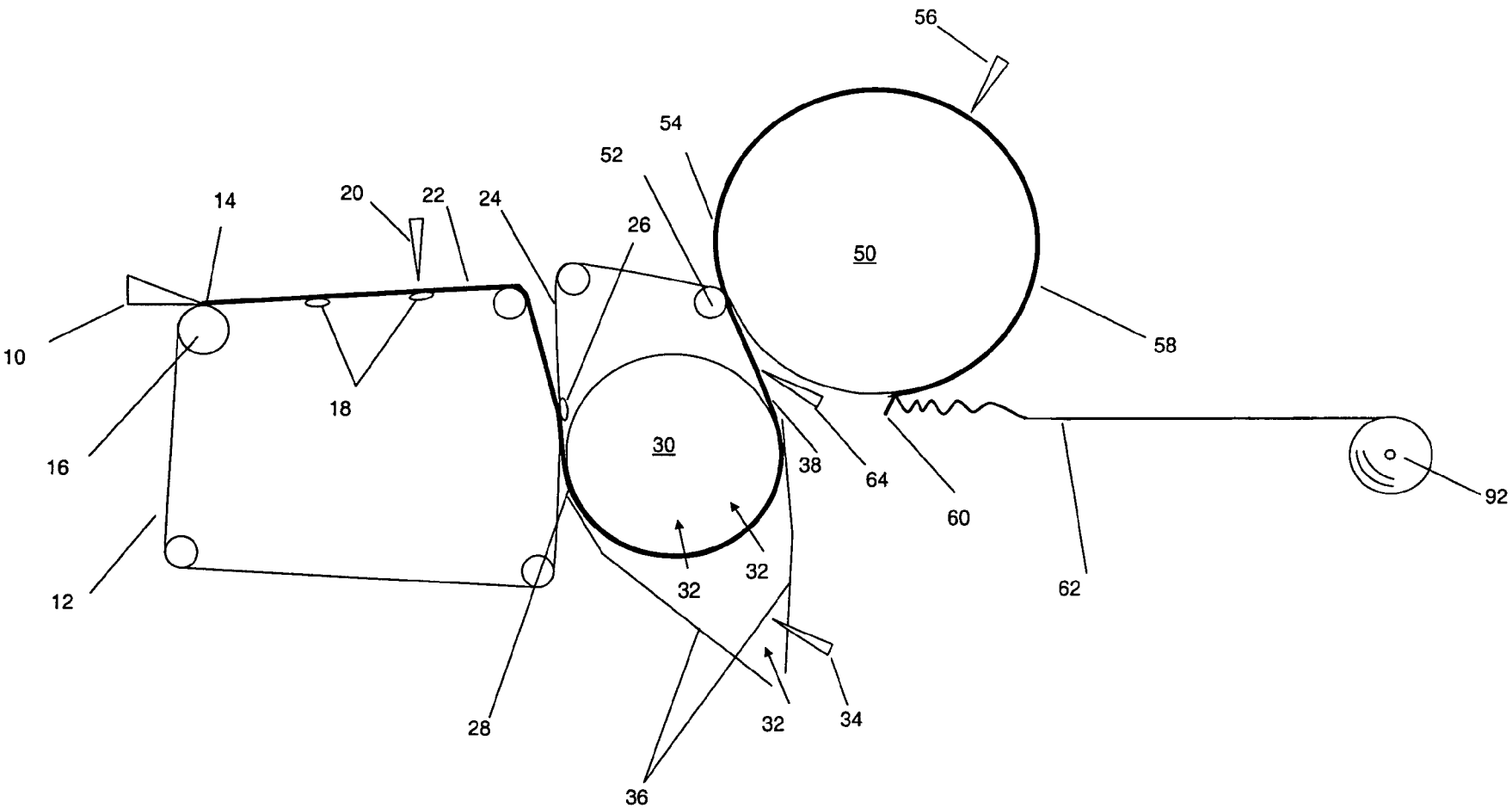
FIG. 2 schematically illustrates a fibrous structure manufacturing device that incorporates another example of a process according to the present invention.
Figure 3:
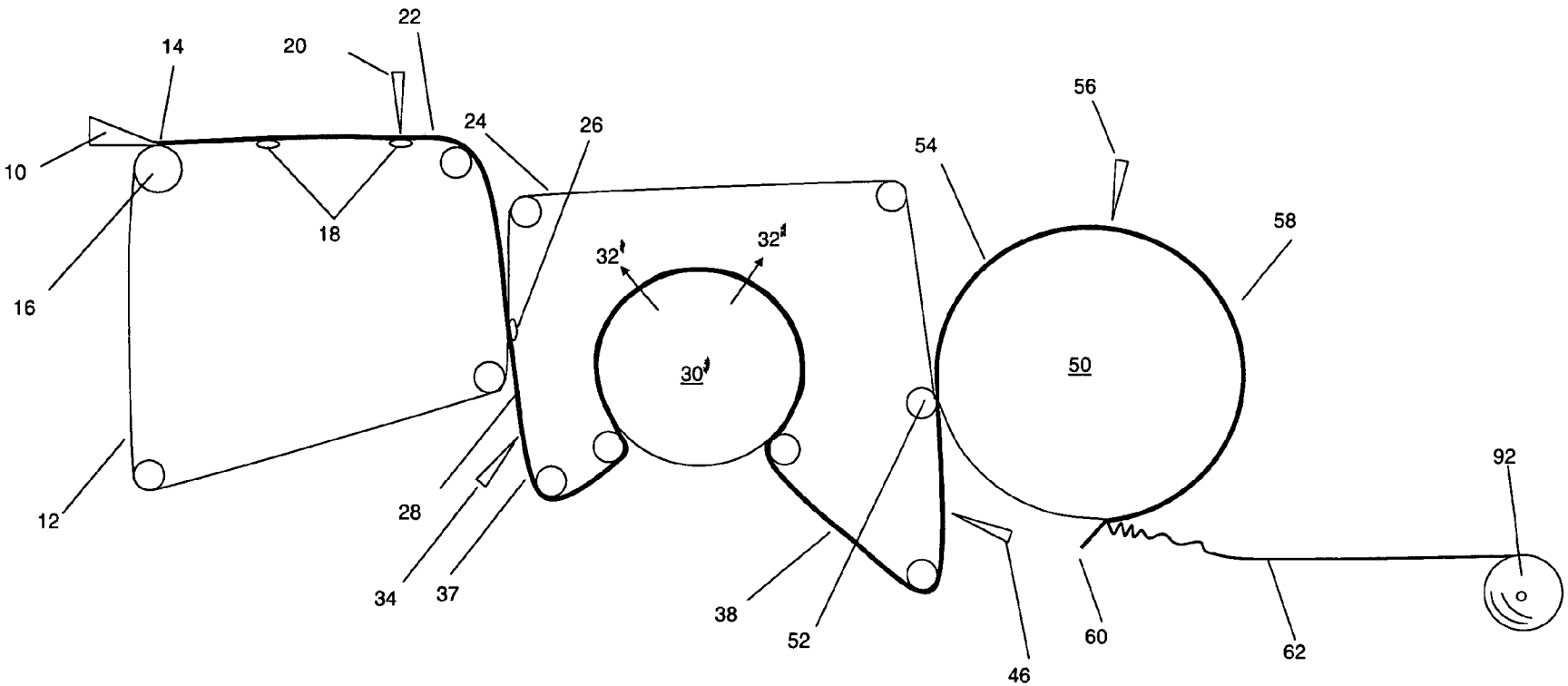
FIG. 3 schematically illustrates a fibrous structure manufacturing device that incorporates another example of a process according to the present invention.

As shown in FIGS. 1-3, web 22 can be transferred to a drying fabric 24. A vacuum shoe 26 can aid in the transfer. The combination 28 of web 22 and drying fabric 24 can pass over a drying drum 30 upon which drying can occur by passing hot, dry air 32 through combination 28 as shown by directional arrows 32 and 32'. A solid additive can be added to the hot air streams 32 by a solid additive applicator 34. Optional hood elements 36 can contain and focus the hot, dry air 32 to facilitate passing it into dryer drum 30. The approximate moisture of the web can be about 70% to about 85% as it initially contacts the drying drum 30 and about 25% to about 65% as it exits the drying drum 30. Drying drum 30 is shown in FIGS. 1-4 as a single drying drum; however, it is provided that two or more drums can be used if needed to provide the needed drying capacity.

As shown in FIG. 1, partially dried web 38 can be transferred to a transfer fabric 40. Vacuum 42 can aid in the transfer. Web 38 atop transfer fabric 40 comprises a composite 44. The composite 44 can be directed past an optional solid additive applicator 46 which applies a solid additive atop the partially dried web 38. This yields a partially dried, surface coated web 48. The approximate moisture content of the web 48 as it receives the solid additive from applicator 46 can be about 25% to about 65%.

Web 48 can be attached to a cylindrical dryer, such as a Yankee dryer 50, with a transfer aided by pressure roll 52. The web 54 atop Yankee 50 can be optionally contacted by a solid additive from solid additive applicator 56 forming a surface coated web 58. The solid additive applicator 56 can be positioned at any point around the periphery of the Yankee 50 thus affecting the moisture content at which application of the solid additive occurs.

As shown in FIG. 2, partially dried web 38 can be optionally contacted by a solid additive from solid applicator 64 prior to its transfer to cylindrical dryer 50. Transfer to the cylindrical dryer 50 can be aided by pressure roll 52. This results in partially dried web 54 being carried by the surface of cylindrical dryer 50. Web 54 can optionally pass through a solid additive application point, wherein a solid additive is applied by applicator 56 resulting in a further coated and further dried web 58.

As shown in FIG. 3, the combination 28 of web 22 and drying fabric 24 can pass through an optional solid additive application zone in which solid applicator 34 applies a solid additive on the surface of web 22 creating solid additive-containing partially dried web 38 still being carried on drying fabric 24. The approximate moisture content at the solid additive applicator 34 can be about 70% to about 85%.

Web 37 can be carried between drying fabric 24 and the surface of a porous drying drum 30' can be partially dried by passing hot, dry air through the web 37 illustrated by directional arrows 32'. The action of drying, yields partially dried web 38 which can be carried by drying fabric 24. The approximate moisture of the web 37 can be about 70% to about 85% as it enters drying drum 30' and about 25% to about 65% as it exits drying drum 30'.

As shown in FIGS. 1-3, the cylindrical dryer, Yankee dryer 50, reduces the approximate moisture content of the web from about 25% to about 65% to about 1% to about 10%. Web 58 can be removed from the Yankee 50 by creping with a doctor blade 60 forming fibrous structure 62. Fibrous structure 62 comprises a solid additive applied from one or more solid additive applicators.

Figure 4:
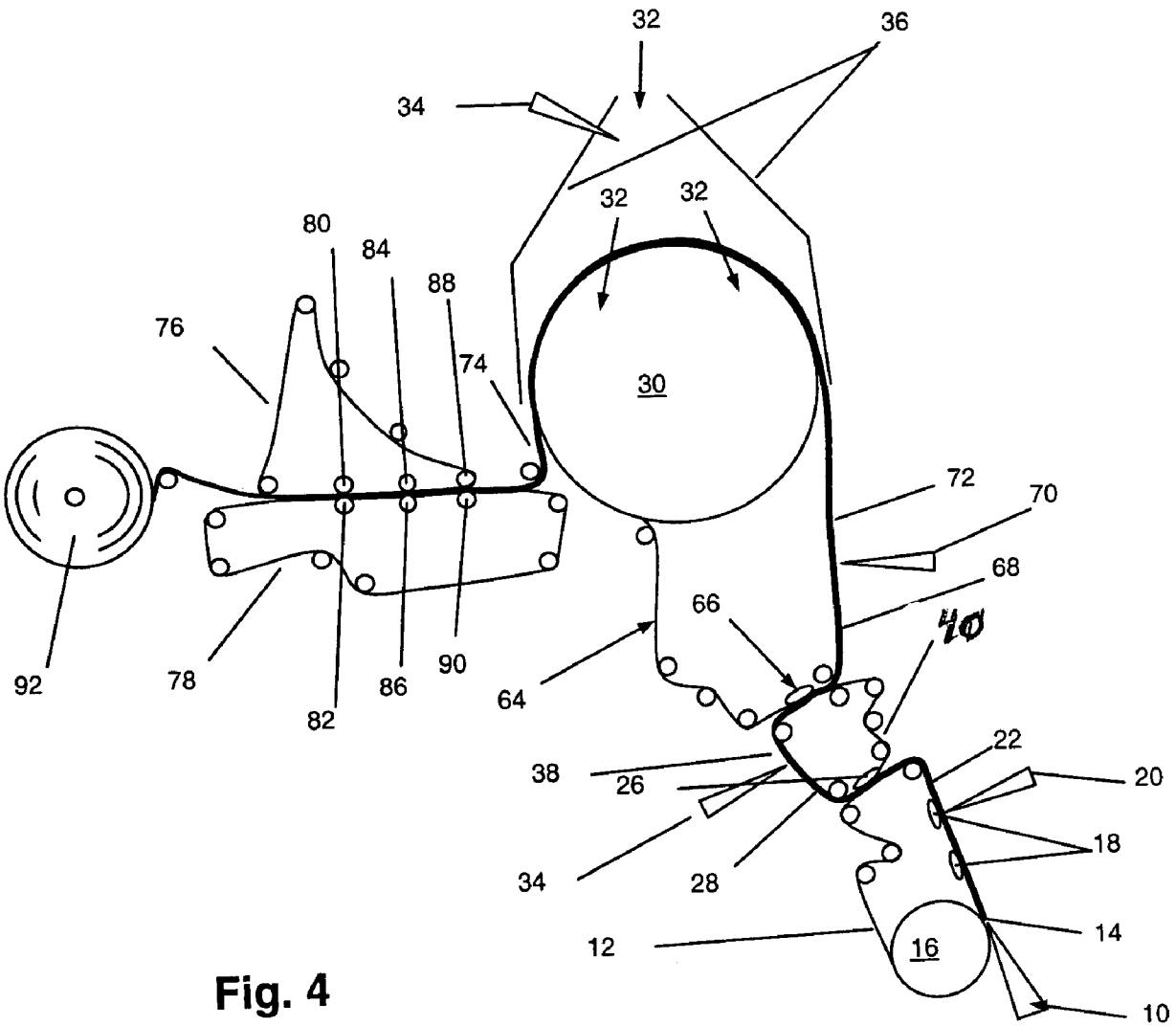
FIG. 4 schematically illustrates a fibrous structure manufacturing device that incorporates another example of a process according to the present invention.

As shown in FIG. 4, web 22 can be transferred to a transfer fabric 40, such as a slower-moving fabric in a rush transfer type of process. Vacuum shoe 26 can aid in the transfer. The combination 28 of web 22 and transfer fabric 40 can pass through optional solid additive application zone in which solid applicator 34 applies solid additive on the surface creating solid additive-containing dewatered web 38 still being carried on transfer fabric 40. The approximate moisture content at the point of solid applicator 34 can be about 65% to about 85%.

Web 38 can be transferred to a drying fabric 64 assisted by vacuum shoe 66 forming a composite 68 of web 38 and drying fabric 64. Drying fabric 64 can be carried at the same speed or at a different speed compared to transfer fabric 40. The composite 68 can pass through an optional solid additive application zone consisting of solid additive applicator 70. This yields surface coated, dewatered web 72 still supported on drying fabric 64. The approximate moisture content at the point of solid additive applicator 70 can be about 40% to about 70%.

Web 72 can be dried by being contacted by hot, dry air 32 while supported on drying fabric 64 wrapped around the periphery of a drying drum 30, such as a through drier. While hot air 32 can be directed toward web 72, it optionally can entrain a solid additive introduced by solid additive applicator 34. The solid additive laden hot air can be contained by hood elements 36 and pass through web 72 at points represented by directional arrows 32. The approximate moisture of the web can be from about 40% to about 70% as it enters drying drum 30 and from about 1% to about 10% as it exits drying drum 30. Prior to being wound on a spool forming a roll of the fibrous structure containing a solid additive, the web 74 can be directed through a series of fixed gap fabric nips formed between fabrics 76 and 78. Nips are formed between roll pairs 80 and 82, 84 and 86, and 88 and 90.

The finished fibrous structure made by any of these processes can be wound upon a spool forming a parent roll 92. The parent roll 92 may be unwound in any suitable converting process if desired.

Figure 5:
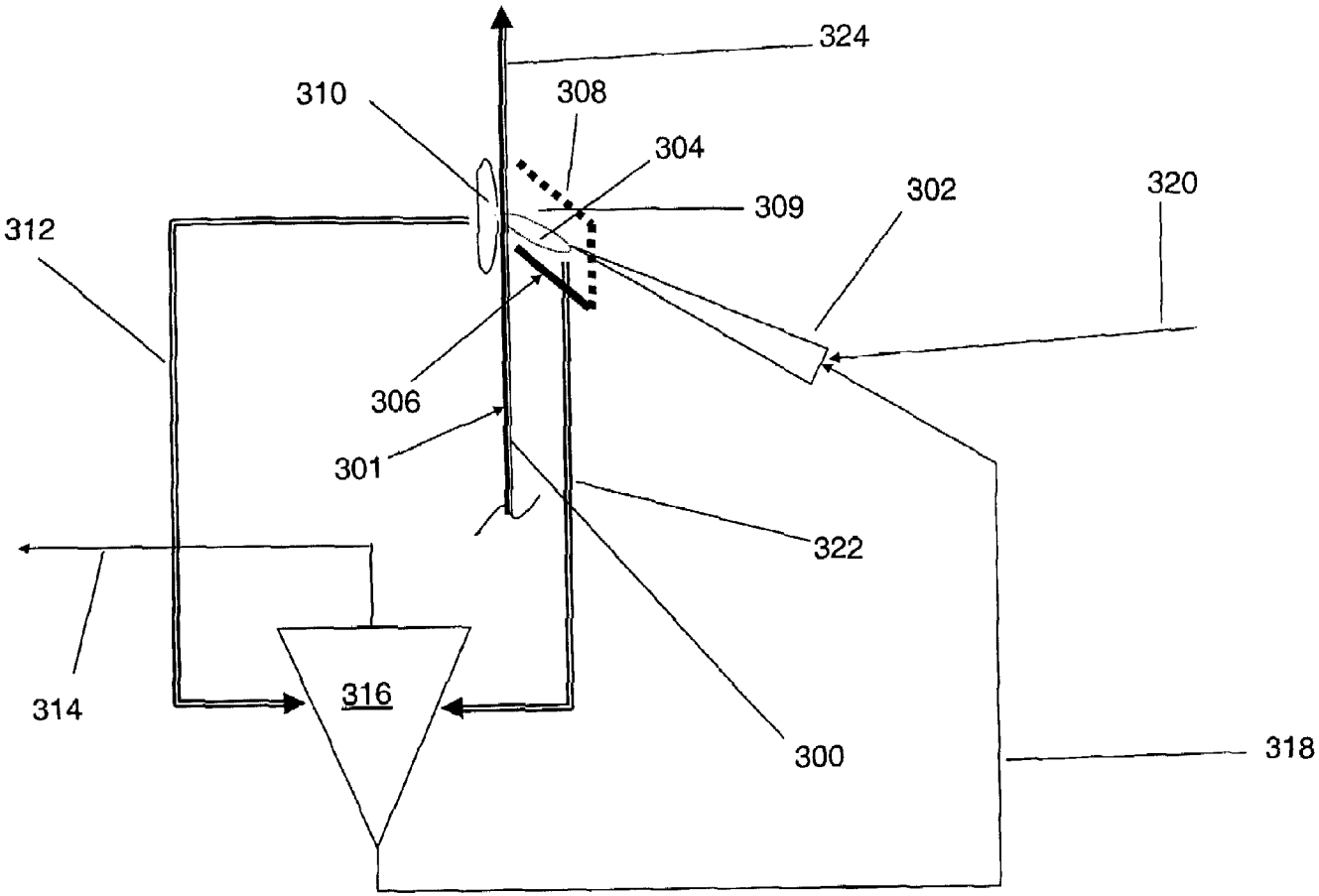
FIG. 5 schematically illustrates a portion of a fibrous structure manufacturing device that incorporates another example of a process according to the present invention.

FIG. 5 provides more detailed enlarged view of a suitable solid additive applicator.

The solid additive 320 can be supplied from a reservoir (not shown) to a suitable applicator 302.

Part or all of the supply of solid additive to applicator 302 can be served by stream 318 which comprises the recycled solid additive recovered from the application zone. The creation of stream 318 is discussed in more detail below.

Applicator 302 can emit solid additive suspended in air 304 directed at fibrous web 300. Fibrous web 300 can be optionally supported on a surface 301. Suitable surfaces 301 include a carrier fabric and/or a solid surface such as a dryer drum.

Baffle 306 can be used to advantage to deflect any boundary layer air which web 300 carries near its surface. This baffle can take the form of an enclosed hood if elements 308 are included. In such a case, zone 309 is controlled to be at reduced air pressure relative to atmosphere. Recovery cyclone 316 which is equipped with vacuum line 314 can provide such a reduced pressure in zone 309. This creates a stream 322 comprising air with entrained solid additive which is not retained on the surface of web 300.

If carrier surface 301 is porous, a vacuum shoe represented by element 310, can be used to aid in the deposition of the solid additive suspension 304 onto web 300. Solid additive which passes into the vacuum shoe can be entrained in air in stream 312 directed toward cyclone recovery 316, which can be powered by vacuum 314. The concentrated solids from recovery cyclone 316 accumulate in stream 318 which as mentioned earlier can be combined with the virgin stream flow 320 to form the feed of solid additive to applicator 302.

Web 300 after passing through the solid application zone is coated web 324 still supported on surface 301.

If the fibrous structure is unsupported at any point during the papermaking and/or converting process, an applicator can be positioned on both sides of the fibrous structure such that a solid additive can be applied to both surfaces of a fibrous structure. In addition to the drying fabric, a grounding material, separate from the fibrous structure, may be positioned on the side of the fibrous structure opposite the applicator. This grounding material may be a patterned grounding material.

Alternatively, the solid additive of the present invention may be applied to a semi-dry fibrous structure, for example while the fibrous structure is on the Fourdrinier cloth, on a drying felt or fabric, or while the fibrous structure is in contact with the Yankee dryer or other alternative drying device.

Finally, the solid additive can also be applied to a dry fibrous structure in moisture equilibrium with its environment as the fibrous structure is unwound from a parent roll as for example during an off-line converting operation.

In another example, the solid additive of the present invention may be applied after the fibrous structure has been dried and creped, and, more preferably, while the fibrous structure is still at an elevated temperature. Preferably, the solid additive is applied to the dried and creped fibrous structure before the fibrous structure is wound onto the parent roll.

The solid additive can be added to either side of the fibrous structure singularly, or to both sides; preferably, the chemical additive is applied to only one side of the fibrous structure; the side of the fibrous structure with raised regions. Such raised regions can be orientated toward the exterior surface of the ultimate sanitary tissue paper product or toward the interior depending on the nature of the solid additive. Suitably the present invention is useful to apply a solid additive to a fibrous structure at a level of at least about 0.1% and/or at least about 0.3% and/or at least about 0.5% by weight of the fibrous structure.

In one example, electrical charges are created to the solid additive prior to contacting a surface of the fibrous structure. To aid in the delivery of the solid additive to a surface of the fibrous structure, the fibrous structure may be grounded, directly or indirectly. In one example, the fibrous structure is grounded via the presence of moisture, such as water, in the fibers in the fibrous structure which provides a conductive connection to earth. In another example, the fibrous structure may be grounded by the positioning of a grounding device adjacent to, preferably in contact with, a surface of the fibrous structure opposite the surface upon which the solid additive is to be applied.

In one example, the solid additive contacts a surface of the fibrous structure such that the solid additive is present on the surface of the fibrous structure at a greater level than within the fibrous structure.

In one example, the solid additive may contact the fibrous structure via a non-contacting method. A nonlimiting example of a non-contacting applicator comprises a step of electrostatically charging the solid additive prior to contacting the fibrous structure with the electrically charged solid additive.

In one example, at least 10% of the solid additive that contacts the fibrous structure is retained by the fibrous structure. Contacting is defined as depositing onto, into and/or passing through the entire thickness of the fibrous structure.

In another example, the process further comprises the step of capturing the solid additive that is not retained by the fibrous structure. The captured solid additive may contact the fibrous structure again.

The step of capturing the solid additive may comprise the step of applying a vacuum opposite the application side of the fibrous structure in order to direct particles which are not retained by the fibrous structure into the air stream of the vacuum such that they can be recovered by a suitable means such as screening or centrifugation.

Fluidizable Mixture

In one example, the solid additive may be present in, or as, a fluidizable mixture prior to contacting the fibrous structure. The fluidizable mixture may consist of a solid additive and optionally a fluidizing agent, wherein the fluidizing agent may be a solid additive as described herein.

In another example, the fluidizing agent comprises an inorganic silicate. A nonlimiting example of an inorganic silicate is a clay. In one example the fluidizing agent comprises kaolin clay.

In one example, the fluidizable mixture comprises a carbohydrate polymer solid additive. A nonlimiting example of a suitable carbohydrate polymer is starch. The starch may comprise native corn starch.

In one example, the fluidizing agent facilitates the fluidization of the solid additive such that the solid additive may be delivered to the surface of the fibrous structure. In one example, the fluidizing agent is a non-liquid. In another example, the fluidizing agent is a non-gas. In yet another example, the fluidizing agent may be a solid additive in accordance with the present invention.

Nonlimiting examples of suitable fluidizing agents include particles having a density greater than the density of the solid additive.

Nonlimiting examples of suitable fluidizing agents include particles that exhibit an average particle size less than the average particle size of the solid additive.

Nonlimiting examples of suitable fluidizing agents include particles that exhibit a sphericity less than the sphericity of the solid additive.

In one example, the fluidizable mixture of the present invention comprises a fluidizing agent that exhibits a density that is greater than the density of the solid additive excluding the fluidizing agent. In one example, the fluidizing agent exhibits a density that is greater than the density of the solid additive excluding the fluidizing agent by at least about 0.3 $g/cm^3$ and/or at least about 0.5 $g/cm^3$ and/or at least about 0.7 $g/cm^3$ and/or at least about 1.0 $g/cm^3$.

In one example, the density of the fluidizing agent may be less than about 10 $g/cm^3$ and/or less than about 8 $g/cm^3$ and/or less than about 6 $g/cm^3$ and/or less than about 4 $g/cm^3$ and/or less than about 3 $g/cm^3$ and/or less than about 1 $g/cm^3$ to about 0.001 $g/cm^3$ and/or to about 0.1 $g/cm^3$ and/or to about 0.5 $g/cm^3$.

In one example, the fluidizable mixture of the present invention comprises a fluidizing agent that exhibits an average particle size (particle size mean) that is less than the average particle size of the solid additive excluding the fluidizing agent. In one example, the fluidizing agent exhibits an average particle size that is less than the average particle size of the solid additive excluding the fluidizing agent by at least about 100 μm and/or at least about 75 μm and/or at least about 50 μm and/or at least about 25 μm and/or at least about 10 μm and/or at least about 5 μm and/or at least about 3 μm.

In one example, the fluidizing agent exhibits an average particle size (particle size mean) of less than about 300 μm and/or less than about 200 μm and/or less than about 100 μm and/or less than about 60 μm and/or less than about 45 μm and/or less than about 25 μm and/or less than about 15 μm and/or less than about 10 μm and/or less than about 2 μm.

In one example, the fluidizable mixture of the present invention comprises a fluidizing agent that exhibits a sphericity less than the sphericity of the solid additive excluding the fluidizing agent. In one example, the fluidizing agent exhibits a sphericity that is less than the sphericity of the solid additive by at least about 0.1 and/or at least about 0.2 and/or at least about 0.3 and/or at least about 0.4 and/or at least about 0.5.

In one example, the fluidizing agent exhibits a spheriticity of less than about 0.9 and/or less than about 0.8 and/or less than about 0.6 and/or less than about 0.5 and/or less than about 0.3.

In one example, the fluidizable mixture comprises a carbohydrate polymer, such as a solid additive starch, and a fluidizing agent, such as an inorganic mineral, for example kaolin clay. Clay particles, such as kaolin clay, generally exhibit a smaller average particle size; greater density; and, a lower sphericity than solid additives, especially carbohydrate polymer solid additives. In this example, the inorganic mineral is also a solid additive as described herein.

Solid Additive

Nonlimiting examples of suitable solid additives may be selected from the group consisting of: fillers, inks, dyes, medicines, opacifiers, abrasives, adhesives, wet strengthening additives, dry strengthening additives, odor control aids, absorbency aids, lotions, softeners, low surface energy particles, surface friction modifying agents, antivirucidal agents, perfume agents, skin care agents, carbohydrate polymers, antibacterial agents, hydrophobic polymers and mixtures thereof In one example, the solid additive is a hygro-activated material. In other words, the solid additive changes its chemical and/or physical properties upon being exposed to a certain level of a liquid, such as water.

In another example, the solid additive is a thermally-activated material. In other words, the solid additive changes its chemical and/or physical properties upon being exposed to a certain temperature.

Nonlimiting examples of fillers include clays and/or talc. Nonlimiting examples of suitable clays include kaolin clays, bentonite clays (e.g., laponite clays commercially available from Southern Clay) and mixtures thereof. The clays may be modified, such as chemically modified and/or physically modified, or they may be unmodified.

Nonlimiting examples of opacifiers include titanium dioxide.

Nonlimiting examples of adhesives include thermoplastic polymers, nonlimiting examples of which include polyolefins, polyesters, polyamides, polyurethanes and mixtures thereof and/or thermosetting polymers, nonlimiting examples of which include polyesters, polyurethanes, epoxy and mixtures thereof.

Nonlimiting examples of absorbency aids include superabsorbent materials, nonlimiting examples of which include cross-linked cellulose ethers, polyacrylates and mixtures thereof.

Nonlimiting examples of low surface energy particles include fluorocarbon polymer particles, silicone polymer particles and mixtures thereof. In one example, the fluorocarbon polymer particle comprises polytetrafluoroethylene (PTFE). In one example, the silicone polymer particle comprises polydimethyl siloxane.

Nonlimiting examples of hydrophobic polymers include anionic, cationic, nonionic and amphoteric polyurethanes, polyurethane-acrylics, polyurethane-polyvinylpyrrolidones, polyesters, polyester-polyurethanes, polyesteramides, fatty-chain polyesters wherein the fatty-chain comprises at least twelve (12) carbon atoms, polyamide resins, ethylene-glycol adipates, polyethylene glycol adipates, random copolymer reaction products of alkylene oxide and alcohol, polytriethylene glycols, polyethylene glycols and mixtures thereof.

Nonlimiting examples of carbohydrate polymers include starch, starch derivatives, cellulose, cellulose derivatives, guar, xanthan, arabinogalactan, carrageen, chitin, chitin derivatives, chitosan, chitosan derivatives and mixtures thereof.

In one example, the density of the solid additive may be less than about 7 g/cm$^3$ and/or less than about 5 g/cm$^3$ and/or less than about 4 g/cm$^3$ and/or less than about 3 g/cm$^3$ and/or less than about 2 g/cm$^3$ and/or less than about 1 g/cm$^3$ to about 0.001 g/cm$^3$ and/or to about 0.01 g/cm$^3$ and/or to about 0.1 g/cm$^3$ and/or to about 0.5 g/cm$^3$.

In one example, the solid additive exhibits an average particle size (particle size mean) of less than about 300 μm and/or less than about 200 μm and/or less than about 100 μm and/or less than about 60 μm and/or less than about 45 μm and/or less than about 25 μm and/or less than about 15 μm and/or less than about 10 μm and/or less than about 2 μm. In one example, the solid additive may exhibit an average particle size of less than about 300 μm to about 0.001 μm and/or less than about 200 μm to about 0.001 μm and/or less than about 100 μm to about 0.01 μm and/or less than about 60 μm to about 0.1 μm.

In one example, the solid additive exhibits a sphericity of less than 1 and/or less than about 0.8 and/or less than about 0.6 and/or less than about 0.5 and/or less than about 0.3.

The fluidizable mixture and/or the fibrous structure may comprise two or more different solid additives. Such different solid additives may differ from each other by chemical composition, aspect ratio, average particle size, sphericity and/or density. At least one of the solid additives may function as a fluidizing agent to facilitate the fluidization to enhance delivery to the surface of the fibrous structure of at least one of the other solid additives In one example, the solid additive comprises a carbohydrate polymer, such as a solid additive starch, and an inorganic mineral, for example kaolin clay. Generally, clays, such as kaolin clay, exhibit a smaller average particle size; greater density; and, a lower sphericity than native carbohydrate polymer solid additives.

Non-Solid Additives

In addition to the solid additives, the fibrous structures of the present invention may comprise suitable non-solid additives as are known in the art.

Fibrous Structures Made by Processes

The solid additive may be present on a surface of a fibrous structure in a random or uniform pattern. One solid additive may be present on a surface of a fibrous structure in a random pattern and a different solid additive may be present on the surface in a uniform pattern.

Nonlimiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

The fibrous structures and/or sanitary tissue products of the present invention may exhibit a basis weight of between about 10 g/m$^2$ to about 120 g/m$^2$ and/or from about 14 g/m$^2$ to about 80 g/m$^2$ and/or from about 20 g/m$^2$ to about 60 g/m$^2$.

The fibrous structures and/or sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structure and/or sanitary tissue products of the present invention may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The fibrous structures and/or sanitary tissue products of the present invention may exhibit a stretch at peak load of at least about 10% and/or at least about 15% and/or at least about 20% and/or from about 10% to about 70% and/or from about 10% to about 50% and/or from about 15% to about 40% and/or from about 20% to about 40%.

The fibrous structures of the present invention and/or sanitary tissue products comprising such fibrous structures may exhibit an average lint value, as determined by the Lint Test Method described herein, of greater than about 1.0 and/or greater than about 1.5 and/or greater than about 2.0 and/or greater than about 3.0 and/or greater than about 1.0 to about 20 and/or about 15 and/or to about 13 and/or to about 10 and/or to about 8.

The solid additives present on the fibrous structures of the present invention and/or sanitary tissue products comprising such fibrous structures may be associated with the fibrous structures such that little or no solid additives become disassociated from the fibrous structures as dust.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structure may exhibit regions of higher density compared to other regions within the fibrous structure and a solid additive may be present in the regions of higher density at a weight level greater than the weight % level of the solid additive in the other regions of the fibrous structure. For example, the solid additive may be present on the knuckle regions of a fibrous structure at a different weight % level than on the pillow regions of the fibrous structure.

Synthesis Example for Making a Fibrous Structure

The following Example illustrates preparation of sanitary tissue product comprising a fibrous structure according to the present invention on a pilot-scale Fourdrinier fibrous structure making machine.

An aqueous slurry of NSK of about 3% consistency is made up using a conventional repulper and is passed through a stock pipe toward the headbox of the Fourdrinier.

In order to impart temporary wet strength to the fibrous structure, a 1% dispersion of temporary wet strengthening additive (e.g., Parez®) is prepared and is added to the NSK stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

An aqueous slurry of eucalyptus fibers of about 3% by weight is made up using a conventional repulper.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are both directed to a layered headbox capable of maintaining the slurries as separate streams until they are deposited onto a forming fabric on the Fourdrinier.

The fibrous structure making machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus fibers and 30% is made up of the NSK fibers. This combination results in an average fiber length of about 1.6 mm. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 12 mils above the supporting fabric. A suitable process for making the patterned drying fabric is described in published application US 2004/0084167 A1.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the web exits the blow-through pre-dryers, solid additive is applied using a VersaSpray 2 electrostatic applicator and SureCoat controller from the Nordson Corporation of Amherst, Ohio. The solid additive in this example is a blend of 85% corn starch and 15% kaolin. The corn starch is trade named International PFP from Pocahontas Food Products of Richmond Va. The kaolin is trade named WP Dry from Imerys of Roswell, Ga. The starch and kaolin are thoroughly mixed and then placed in a model HR-8-80 hopper from Nordson Corporation. A minimum amount of air pressure (from ½ to 20 psi) is used to fluidize the solid additive in the hopper.

Settings of 95 kV and 50 μA are entered into the SureCoat controller to set up a negative corona charge at the tip of the VersaSpray 2 electrostatic applicator. A venturi pump with orifice diameter of 5 mm transports solid additive from the hopper to the web. Flow Rate air pressure of 20 psi and Atomizing air pressure of 15 psi provide about 175 g/min of solid additive out of each venturi pump. Fan spray nozzles with a 2.5 mm×13 mm opening are used to direct the solid additive flow to the web. The nozzles are placed 3" from the web, orthogonal to the plane of the web, and aimed at the trailing edge of a ⅝" rectangular slot in a vacuum box placed behind the patterned drying fabric. The flat spray of solid additive is aligned parallel to the web's cross direction. A vacuum of 10 inches of Hg is applied to the vacuum box. The vacuum captures the majority of solid additive that does not remain with the web. At a 50% first pass retention, about 4 $g/m^2$ of solid additive is applied to the 21 $g/m^2$ of fiber.

The semi-dry web is then transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 656 feet per minute. The fibrous structure may be subsequently converted into a two-ply sanitary tissue product having a basis weight of about 50 g/m$^2$ in one case with solid additive coated surface directed outwards and in a second case with solid additive coated surface directed inwards. The average lint value of the sanitary tissue product made by converting with the solid additive on the outside surface is about 3. The lint value of a sanitary tissue product made by converting with the solid additive on the inside is about 6. A similarly made sanitary tissue product, omitting the solid additive step and equalizing basis weight by increasing the weight of the NSK and eucalyptus proportionally, has a lint value of about 7.

Test Methods

Lint Test Method:

The amount of lint generated from a fibrous structure is determined with a Sutherland Rub Tester. This tester uses a motor to rub a weighted felt 5 times over the fibrous structure, while the fibrous structure is restrained in a stationary position. This fibrous structure can be is referred to throughout this method as the "web". The Hunter Color L value is measured before and after the rub test. The difference between these two Hunter Color L values is then used to calculate a lint value. This lint method is designed to be used with white or substantially white fibrous structures and/or sanitary tissue products. Therefore, if testing of a non-white tissue, such as blue-colored or peach-colored tissue is desired, the same formulation should be used to make a sample without the colored dye, pigment, etc, using bleached kraft pulps.

i. Sample Preparation

Prior to the lint rub testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48 to 52% and within a temperature range of 22° C. to 24° C. This rub testing should also take place within the confines of the constant temperature and humidity room.

The Sutherland Rub Tester may be obtained from Testing Machines, Inc. (Amityville, N.Y., 1701). The web is first prepared by removing and discarding any product which might have been abraded in handling, e.g. on the outside of the roll. For products formed from multiple plies of webs, this test can be used to make a lint measurement on the multi-ply product, or, if the plies can be separated without damaging the specimen, a measurement can be taken on the individual plies making up the product. If a given sample differs from surface to surface, it is necessary to test both surfaces and average the values in order to arrive at a composite lint value. In some cases, products are made from multiple-plies of webs such that the facing-out surfaces are identical, in which case it is only necessary to test one surface. If both surfaces are to be tested, it is necessary to obtain six specimens for testing (Single surface testing only requires three specimens). Each specimen should be folded in half such that the crease is running along the cross direction (CD) of the web sample. For two-surface testing, make up 3 samples with a first surface "out" and 3 with the second-side surface "out". Keep track of which samples are first surface "out" and which are second surface out.

Obtain a 30".times.40" piece of Crescent #300 cardboard from Cordage Inc. (800 E. Ross Road, Cincinnati, Ohio, 45217). Using a paper cutter, cut out six pieces of cardboard of dimensions of 2.5".times.6". Puncture two holes into each of the six cards by forcing the cardboard onto the hold down pins of the Sutherland Rub tester.

Center and carefully place each of the 2.5×6" cardboard pieces on top of the six previously folded samples. Make sure the 6" dimension of the cardboard is running parallel to the machine direction (MD) of each of the tissue samples. Center and carefully place each of the cardboard pieces on top of the three previously folded samples. Once again, make sure the 6" dimension of the cardboard is running parallel to the machine direction (MD) of each of the web samples.

Fold one edge of the exposed portion of the web specimen onto the back of the cardboard. Secure this edge to the cardboard with adhesive tape obtained from 3M Inc. (¾" wide Scotch Brand, St. Paul, Minn.). Carefully grasp the other over-hanging tissue edge and snugly fold it over onto the back of the cardboard. While maintaining a snug fit of the web specimen onto the board, tape this second edge to the back of the cardboard. Repeat this procedure for each sample.

Turn over each sample and tape the cross direction edge of the web specimen to the cardboard. One half of the adhesive tape should contact the web specimen while the other half is adhering to the cardboard. Repeat this procedure for each of the samples. If the tissue sample breaks, tears, or becomes frayed at any time during the course of this sample preparation procedure, discard and make up a new sample with a new tissue sample strip.

There will now be 3 first-side surface "out" samples on cardboard and (optionally) 3 second-side surface "out" samples on cardboard.

ii. Felt Preparation

Obtain a 30".times.40" piece of Crescent #300 cardboard from Cordage Inc. (800 E. Ross Road, Cincinnati, Ohio, 45217). Using a paper cutter, cut out six pieces of cardboard of dimensions of 2.25".times.7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket, 550 Broad Street, Bristol, Conn. 06010) to the dimensions of 2.25".times.8.5".times.0.0625". Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single web sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot.

Next, rub test the 24 cardboard/felt boards of the new lot and the 24 cardboard/felt boards of the old lot as described below. Make sure the same web lot number is used for each of the 24 samples for the old and new lots. In addition, sampling of the web in the preparation of the cardboard/tissue samples must be done so the new lot of felt and the old lot of felt are exposed to as representative as possible of a tissue sample. Discard any product which might have been damaged or abraded. Next, obtain 48 web samples for the calibration. Place the first sample on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "F" (for "first-side") Mark the next highest number with the letter "S" (for second-side). Continue marking the samples in this alternating "F"/"S" pattern. Use the "F" samples for first surface "out" lint analyses and the "S" samples for second-side surface "out" lint analyses. There are now a total of 24 samples for the new lot of felt and the old lot of felt. Of this 24, twelve are for first-side surface "out" lint analysis and 12 are for second-side surface "out" lint analysis.

Rub and measure the Hunter Color L values for all 24 samples of the old felt as described below. Record the 12 first-side surface Hunter Color L values for the old felt. Average the 12 values. Record the 12 second-side surface Hunter Color L values for the old felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first-side surface and the delta average difference for the second-side surface and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 first-side surface Hunter Color L values for the new felt. Average the 12 values. Record the 12 second-side surface Hunter Color L values for the new felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first side surface and the delta average difference for the second-side surface and divide this sum by 2. This is the uncorrected lint value for the new felt.

Take the difference between the corrected Lint Value from the old felt and the uncorrected lint value for the new felt. This difference is the felt correction factor for the new lot of felt. Adding this felt correction factor to the uncorrected lint value for the new felt should be identical to the corrected Lint Value for the old felt. Note that the above procedure implies that the calibration is done with a two-surfaced specimen. If it desirable or necessary to do a felt calibration using a single-surfaced sample, it is satisfactory; however, the total of 24 tests should still be done for each felt.

iii. Care of 4 Pound Weight

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off. When not in use, the weight must be positioned such that the pads are not supporting the full weight of the weight. It is best to store the weight on its side.

iv. Rub Tester Instrument Calibration

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test.

Prepare a test specimen on cardboard sample as described above. In addition, prepare a felt on cardboard sample as described above. Both of these samples will be used for calibration of the instrument and will not be used in the acquisition of data for the actual samples.

Place this calibration web sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the web sample and not the web sample itself. The felt must rest flat on the tissue sample and must be in 100% contact with the web surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the web sample at the beginning and end of this test, the tester is calibrated and ready to use. If the total number of strokes is not five or if the end of the felt covered weight closest to the operator is over the actual web sample either at the beginning or end of the test, repeat this calibration procedure until 5 strokes are counted the end of the felt covered weight closest to the operator is situated over the cardboard at the both the start and end of the test. During the actual testing of samples, monitor and observe the stroke count and the starting and stopping point of the felt covered weight. Recalibrate when necessary.

v. Hunter Color Meter Calibration

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary. Place the white standard plate on the sample stage under the instrument port. Release the sample stage and allow the sample plate to be raised beneath the sample port. Using the "L-Y", "a-X", and "b-Z" standardizing knobs, adjust the instrument to read the Standard White Plate Values of "L", "a", and "b" when the "L", "a", and "b" push buttons are depressed in turn.

vi. Measurement of Samples

The first step in the measurement of lint is to measure the Hunter color values of the black felt/cardboard samples prior to being rubbed on the web sample. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit. If a D25D2A head is in use, lower the felt covered cardboard and plate, rotate the felt covered cardboard 90° so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual web sample/cardboard combinations, place the web sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight Hook this weight onto the tester arm and gently place the web sample underneath the weight/felt combination. The end of the weight closest to the operator must be over the cardboard of the web sample and not the web sample itself. The felt must rest flat on the web sample and must be in 100% contact with the web surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the web sample. If torn, discard the felt and web sample and start over. If the web sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples. After all web specimens have been measured, remove and discard all felt. Felts strips are not used again. Cardboards are used until they are bent, torn, limp, or no longer have a smooth surface.

vii. Calculations

Determine the delta L values by subtracting the average initial L reading found for the unused felts from each of the measured values for the first-side surface and second-side surface sides of the sample as follows.

For samples measured on both surfaces, subtract the average initial L reading found for the unused felts from each of the three first-side surface L readings and each of the three second-side surface L readings. Calculate the average delta for the three first-side surface values. Calculate the average delta for the three second-side surface values. Subtract the felt factor from each of these averages. The final results are termed a lint for the first-side surface and a lint for the second-side surface of the web.

By taking the average of the lint value on the first-side surface and the second-side surface, the lint is obtained which is applicable to that particular web or product. In other words, to calculate lint value, the following formula is used:

$$\text{Lint Value} = \frac{\text{Lint Value, first-side} + \text{Lint Value, second-side}}{2}$$

For samples measured only for one surface, subtract the average initial L reading found for the unused felts from each of the three L readings. Calculate the average delta for the three surface values. Subtract the felt factor from this average. The final result is the lint value for that particular web or product.

Determination of Surface Concentration of Solid Additive Test Method

Any method which quantitatively compares the surface concentration of the solid additive to the concentration beneath that surface is satisfactory for determining whether a fibrous structure meets the requirements of the present invention. The ideal method examines a relatively thin depth of the fibrous structure corresponding to the target surface and compares the concentration of solid additive found in that depth to the concentration found in the fibrous structure in an equivalent depth lying just below this surface depth.

Two problems arise in implementing this ideal. The first is that quantitative analysis of concentration requires determining a ratio of solid additive to total material. As the section defining the surface approaches zero depth, the fraction approaches the indeterminate form %.

The second issue is that it is recognized that fibrous structures do not have a smooth surface. The surface is a fractal geometry meaning that the contour following the surface becomes more and more intricate as the observer uses a smaller and smaller scale to examine it.

The following definition and example method address these issues.

For the purposes of the present invention a part of the fibrous structure can be regarded as residing on the surface of that structure if the structure contains a plane parallel to the center of the structure and containing the point in question sections the fibrous structure into two parts such that the mass in the part of the outward from the plane toward the target side is relatively small compared to the amount of mass inward toward the center of the structure.

For fibrous structures of homogeneous fiber content, inventors have found it suitable if such a plane divides the structure into a surface plane have a percentage of mass of at least about 2.5% and at most about 6.25% and a bulk plane have a percentage of mass of at least about 93.75% and at most about 97.5%.

An example testing method is a tape method of extracting layers of fibers and solid additive from a fibrous structure in order to identify the stratification of the solid additive. To implement the method, a fibrous structure, typically a sheet of paper, towel or tissue is selected which is clean and free of folds, wrinkles and blemishes.

The target side, opposite side and the machine direction of the sheet are determined. The target side comprises the surface of interest with respect to potentially carrying the solid additive within the bounds of the present invention. The opposite side may also contain solid additive or not.

The sample size should be approximately 27.9 centimeters (11 inches) to 35.56 centimeters (14 inches) in the cross machine direction for the length and 5.08 centimeters (2 inches) to 15.24 centimeters (6 inches) in the machine direction of the width.

The sample of the fibrous structure is placed on a flat surface with the target side up. Thereafter, a strip of tape of approximately 2.5 centimeters (1 inches) in width is removed from a roll of tape. Typically, a transparent tape such as Scotch® brand adhesive tape is used. In the event the adhesive of this tape interferes with the subsequent analysis, any tape of similar adhesion characteristics can be substituted.

The tape strip should be approximately 10.16 centimeters (4 inches) longer than the sample. Static is removed from the tape by wiping the smooth surface of the tape onto or with a soft, damp surface or air stream. The static-free sticky-side of the tape is applied to the top surface of the sample to be tested. The tape is centered in the long direction of the sample and lowered onto the sheet from one end to the other in a gentle touch-down manner. Air pockets are avoided. The tape is not pressed or touched on the surface. This tape is labeled "TARGET" side.

Thereafter, the sample together with the tape is turned upside down. The tail ends of the tape are taped to the flat surface. A second strip of tape is applied to the opposite side of the taped specimen directly above the first strip of tape. This tape is labeled "OPPOSITE" side.

Thereafter, a paper cutter is utilized to trim 0.317 centimeters (⅛ inch) off each edge of the sample. A 2000 gram weight is rolled across the length of the tape specimen on the target surface and opposite surface, once on each side. Pressure is not exerted on the weight. The weight is moved at a uniform slow speed over the surface of the sample.

Subsequently, the two tapes are pulled apart at approximately a 180° angle at a uniform moderate speed. The tapes are not jerked or yanked.

The tape labeled "OPPOSITE" side may be discarded.

The fiber tape split labeled "TARGET" side is positioned on a flat surface with the fiber surface up. The tail ends are taped down. A 2.54 centimeter (1 inch) strip of tape is applied as previously done. The steps identified hereinabove are followed to split the ½ sheet fiber into two ¼ sections. Again, the tape labeled "TARGET" is retained and the other tape may be discarded. Another split is done to divide the ¼ specimen into ⅛ splits. Finally, another split is done to divide the ⅛ specimen into 1/16 splits sectioning the fibrous structure into layers of fiber (and potentially solid additive) attached to tapes. The splits are then identified in sequence starting from the target side of the sample, i.e. the initial tape is labeled #1. The 1/16 split taken immediately adjacent to #1 is labeled #2. Tape #1 contains the surface of the original fibrous structure specimen. Tape #2 is the reference section of the structure.

Briefly, if the concentration solid additive on Tape #1 is greater than Tape #2 then the fibrous structure is said to have its highest concentration of solid additive on the surface. Concentration in this case is defined as the weight of solid additive divided by the total weight of the section of interest of the fibrous structure.

Given the wide variety of solid additives and fiber components embodied in the present invention, it is not possible to specify a single quantitative analysis technique for determining the weight of solid additive which covers all of them. Those skilled in the art of analytical chemistry will recognize that it is possible to use conventional wet chemistry analytical methods, or instrumental analysis such as NMR or XRF, for example. It is also possible to use image analysis if the particle counts and sizes can be easily converted to weights. Caution must be used in all cases to avoid interference of the components of the fibrous structure or the tape with solid additive determination. This might limit the type of tape that can be used if such an interference is found or perhaps a combination of methods would be indicated.

Density Test Method

Density of the solid additive(s) is measured using a Micromeritics' AccuPyc 1330 Pycnometer, which is commercially available from Micromeritics Instrument Company of Norcross, Ga.

A suitable sample cup is weighed. Fill ⅔ of the sample cup volume with the solid additive sample to be tested. Wipe the outside and the inner edge of the sample cup clean of any solid additive residue. Weigh the sample cup with the solid additive sample and note this weight. Quickly remove the cell chamber cap on the AccuPyc, place the sample cup inside it and replace the chamber cap to a finger tight position. Set the AccuPyc such that the AccuPyc operates as follows: purge 10 times with research grade helium at a purge fill pressure of 19.5 psig. Conduct a total of 10 runs, with a run fill pressure of 19.5 psig at an equilibration rate of 0.005 psig/min and under a no use run precision condition. Start the analysis by entering the sample ID and sample weight into the AccuPyc. The resulting density of the solid additive sample is reported as an average of 10 runs and is expressed as $g/cm^3$.

Average Particle Size Test Method

Average particle size of the solid additive(s) is measured using a Horiba LA-910 commercially available from Horiba International Corporation of Irvine, Calif.

One skilled in the art knows that the suitable and appropriate operating conditions for the Horiba LA-910 can be found by running one or more pilot runs on the Horiba LA-910 for the solid additive sample. Visually, one skilled in the art can determine whether the solid additive sample is bimodal or unimodal regarding particle size. If the solid additive sample contains agglomerates, then one of skill in the art will utilize ultrasonics to break up the agglomerates before running the average particle size test. During the pilot run(s), whether the solid additive sample is bimodal or unimodal can be determined. During the pilot runs, one skilled in the art can determine the appropriate agitation and circulation speed, and if the average particle size from the sample is less than 10 μm, can obtain the relative refactive index from Horiba's database.

Follow the Horiba LA-910 Instrument manual to for setup and software use instructions. Obtain the relative refractive index for the solid additive sample to be tested from the Horiba refractive index database.

Input the appropriate measurement conditions into the instrument: Agitation and Circulation Speed—obtained from pilot run(s); Sampling Times 25; Standard Distribution; Dispersant Tank B; Dispersant Volume 200 ml; Dispersant Volume per Step 10 ml; Dilution Point 10%; Rinse Circulation Time 10 seconds; Rinse Repeat Times 1; Rinsing Volume 100 ml; Relative Refractive Index; Good Range Lower Limit 88%; and Good Range Upper Limit 92%.

Drain the cell of the instrument and add 150 mL of the dispersant to the cell and circulate, sonicate for 2 minutes and agitate. If the cell looks clean and the background reading looks flat, run a blank by pressing "Blank". Add the solid additive sample to be tested to the cell while the dispersant is agitating and circulating. Continue to add the solid additive sample slowly until the % T of the laser is 90+/−2 (around 1 mL). Allow the sample to circulate through the cell for 2 minutes. After the sample has circulated for 2 minutes, press "Measure" to analyze the sample. Once the sample is analyzed, print the graph and table. Press "Drain" to drain the cell. Rinse the system three times with deionized water using agitation and sonication for 30 seconds each time. For subsequent samples, repeat steps 2-10. The laser alignment (four triangles) should be checked between samples. The results are reported as follows: 1) a standard resolution histogram for a unimodal distribution or a sharp resolution histogram for a multi-modal distribution; and/or 2) Average Particle Size (Median Diameter).

All documents cited in the Detailed Description of the Invention are, in relevant part, incorporated herein by reference; the citation of any document is not to be considered as an admission that it is prior art with respect to the present invention. Terms or phrases defined herein are controlling even if such terms or phrases are defined differently in the incorporated herein by reference documents.

While particular examples of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for treating a fibrous structure suitable for use in a sanitary tissue product, the process comprising a step of contacting a fibrous structure exhibiting a moisture content of from about 40% to about 70% with a solid additive to form a treated fibrous structure, wherein the solid additive is present on a surface of the treated fibrous structure at a greater level by weight than within the treated fibrous structure and wherein the treated fibrous structure forms a sanitary tissue product which exhibits an average lint value of greater than 1, a density of less than 0.10 g/cm$^3$ and a stretch at peak load of at least 10%.

2. The process according to claim 1 wherein the solid additive is directly bound to a fiber of the fibrous structure.

3. The process according to claim 1 wherein the treated fibrous structure exhibits an average lint value of greater than 1 to less than 10.

4. The process according to claim 1 wherein the solid additive is present in a fluidizable mixture comprising a fluidizing agent prior to contacting the fibrous structure.

5. The process according to claim 4 wherein the fluidizing agent comprises a clay.

6. The process according to claim 1 wherein the step of contacting the fibrous structure comprises delivering the solid additive to the fibrous structure via a non-contacting solid additive applicator.

7. The process according to claim 1 wherein the process further comprises a step of electrostatically charging the solid additive prior to contacting the fibrous structure.

8. The process according to claim 1 wherein at least 10% of the solid additive that contacts the fibrous structure is retained by the fibrous structure.

9. The process according to claim 1 wherein the process further comprises a step of capturing the solid additive that is not retained by the fibrous structure.

10. The process according to claim 9 wherein the process further comprises a step of contacting the fibrous structure with the captured solid additive.

11. A process for making a fibrous structure suitable for use in a sanitary tissue product, the process comprising a step of combining a plurality of pulp fibers and a solid additive such that a fibrous structure is formed, wherein the fibrous structure comprises a surface wherein the solid additive is present on the surface of the fibrous structure at a greater level by weight than within the fibrous structure such that the fibrous structure forms a sanitary tissue product which exhibits an average lint value of greater than 1, a density of less than 0.10 g/cm$^3$ and a stretch at peak load of at least 10%.

12. The process according to claim 11 wherein the process is an air-laid process.

13. The process according to claim 11 wherein the process is a wet-laid process.

14. The process according to claim 11 wherein the fibrous structure is a through-air-dried fibrous structure.

15. The process according to claim 14 wherein the solid additive contacts the through-air-dried fibrous structure prior to contacting a cylindrical dryer.

16. The process according to claim 14 wherein the solid additive is retained at a higher concentration in areas of the through-air-dried fibrous structure corresponding to less pervious regions of a through-air-dried fabric upon which the through-air-dried fibrous structure was carried.

17. The process according to claim 16 wherein the areas exhibit at least 25% moisture at when the solid additive contacts the areas.

* * * * *